US005616060A

United States Patent [19]

Morin

[11] Patent Number: 5,616,060

[45] Date of Patent: Apr. 1, 1997

[54] LEG SUPPORT FOR AQUATIC SKIS

[76] Inventor: Robert Morin, 676 Norvége, #5, Ste-Foy, Québec, Canada, G1X 3E8

[21] Appl. No.: 136,944

[22] Filed: Nov. 23, 1993

[51] Int. Cl.[6] ..... B63B 35/83

[52] U.S. Cl. ..... 441/76

[58] Field of Search ..... 441/75–77, 70; 280/615

[56] References Cited

U.S. PATENT DOCUMENTS

| | | | |
|---|---|---|---|
| 1,013,818 | 1/1912 | Rochat | 441/76 |
| 2,873,713 | 2/1959 | Baastrup . | |
| 3,015,830 | 1/1962 | Clark . | |
| 3,027,576 | 4/1962 | Fines . | |
| 3,034,157 | 5/1962 | Abajian | 441/77 |
| 4,129,912 | 12/1978 | Robinson . | |
| 4,804,345 | 2/1989 | Lee | 440/21 |
| 4,915,659 | 4/1990 | Sanders | 441/76 |
| 5,080,621 | 1/1992 | Nayes | 441/77 |

*Primary Examiner*—Sherman Basinger
*Attorney, Agent, or Firm*—Francois Martineau; Pierre Lespérance

[57] ABSTRACT

The invention relates to a leg support for use on towless water skis, the water skis each defining an elongated buoyant thick ski and an orifice on the top surface of the ski leading to a foot cavity. The leg support is adapted to be positioned adjacent to the orifice on the ski top surface. The leg support comprises a lower rod and an upper rod, pivotally interconnected by an intermediate hinge. The lower rod is pivotally fixed to the ski top surface, while the upper rod is pivotally fixed to a loop band, the latter for being releasably tightened around the calf and tibia of a ski user. Each of the pivotal connections are hinges which permit a movement only in a plane perpendicular to the ski footrest and parallel to the longitudinal axis of the ski. This restriction in movement prevents the user from loosing his stability, for he cannot rotate his ankle in another plane than the above-mentioned plane, and he can thus prevent the drifting of his skis with more ease.

4 Claims, 9 Drawing Sheets

LEG SUPPORT FOR AQUATIC SKIS

FIELD OF THE INVENTION

The present invention generally relates to water skis for use in towless water skiing, and more particularly to leg supports adapted for such skis.

BACKGROUND OF THE INVENTION

It is known in the art to provide a pair of buoyant elongated hulls for use as water skis in towless water skiing, the user standing on these hulls and advancing on water as he would with cross-country skis, for example. Usually, orifices are formed intermediate the length of the elongated hulls on their upper surface, these orifices leading to their respective cavity, each of the latter being correctly dimensioned and adapted for inserting the user's feet. The user's feet are therefore positioned inside the hulls, the hulls upper surfaces being intermediate the user's feet and knees.

A search of the prior art has revealed several pertinent United States patents: U.S. Pat. No. 5,080,621, issued Jan. 14, 1992, to A. W. Nayes; U.S. Pat. No. 4,804,345, issued Feb. 14, 1989, to J. S. Lee; U.S. Pat. No. 3,027,576, issued Sep. 21, 1959, to S. R. Fines; U.S. Pat. No. 4,915,659, issued Apr. 10, 1990, to R. A. Sanders; and U.S. Pat. No. 4,129,912, issued Dec. 19, 1978, to W. L. Robinson.

The main problem that can be found in these (and other similar) inventions is their precarious stability. Indeed, a person standing on the hulls needs to keep his balance in spite of the skis tendancy to drift in a lateral outward direction. Also, the hulls may sway on one side or the other due to the high center of gravity of the user on the hulls, especially once the skis start drifting laterally away from the user.

To prevent the swaying movement, the user will have to exert a considerable ankle rigidness, to keep the hulls steady on the water surface. The outward drifting tendancy will also necessitate a considerable effort on the user's part to keep the skis in an acceptable position, i.e. parallel and separated by a constant distance approximately equal to the width of the shoulders. This effort will have to be combined to the anti-vacillating effort, and will therefore not only be extenuating for the user, but also it will require a great deal of coordination to keep his balance.

ROBINSON partially overcomes this problem by fixing several spring members between his hulls, thus preventing the hulls from drifting apart. But these spring members impede the translation movement of the nautical skier, for when one ski advances more than the other, the spring members exert a stress in both a perpendicular and a parallel direction, relative to the length of the skis. In other words, the spring members not only prevent the skis from drifting apart, they also hinder the back and forth movement that the user exerts on the skis. It is consequently more difficult for the user to travel the same distance with the ROBINSON skis than with skis that are not equipped with the springs.

Thus, it is the present inventor's belief that the existing inventions are not satisfactory in the field of the present invention, due to this lack of stability when the user stands on the hulls.

OBJECTS OF THE INVENTION

It is a general object of this invention to provide a leg support of the character described, for use on towless water skis, which will facilitate the stabilization of the user on the skis.

It is another object of the present invention that the leg support allow free lengthwise movement of the skis in the water.

It is an important object of this invention to provide a simple and easily attachable leg support.

It is another object of this invention that the leg support facilitate the retainment of the stability for a user standing on the skis.

SUMMARY OF THE INVENTION

Conforming with the objects of the invention, the present invention consists of a leg support for use on towless water skis, each of said water skis comprising an elongated buoyant thick ski body defining top and bottom surfaces, an orifice on said ski body top surface leading to a foot cavity for receiving the foot of a user of said ski body on a footrest, said leg support comprising:

a) a loop band, to be releasbly tightened around the calf and tibia of said ski body user;

b) elongated link means having an upper and a lower end;

c) first pivot means, adapted to pivotally connect said lower end of said link means to said ski body, said first pivot means defining a pivotal axis perpendicular to a plane parallel to the longidutinal axis of said ski body and perpendicular to said ski body footrest when connected to said ski body; and d) second pivot means, pivotally connecting said upper end of said link means to said loop band, said second pivot means defining a pivotal axis parallel to said first pivot means pivotal axis, wherein when said first pivot means is connected to said ski body, said loop band is movable over said ski body top surface exclusively about a translational plane perpendicular to the pivotal axes of said first and second pivot means.

Preferably, said elongated link means includes a lower and an upper link member, each having a lower and an upper end, the lower end of said lower link member constituting the lower end of said link means and the upper end of said upper link member constituting the upper end of said link means, said leg support further including a third pivot means, pivotally connecting said lower link member to said upper link member, said third pivot means defining a pivotal axis parallel to the pivotal axes of said first and second pivot means, wherein both lower link members are pivotally movable exclusively in a common plane.

Preferably, said lower link member is an elongated rod.

Advantageously, said first pivot means are positioned on said ski body top surface adjacent the rear of said ski body top surface orifice, but could be positioned on said footrest.

Alternately, said lower link member is a V-shaped rod, said lower link member being adapted and correctly dimensioned to engage said user's leg like a yoke.

Profitably, said first pivot means are then positioned on said ski body top surface edgewisely and laterally relative to said ski body top surface orifice.

Alternately, said lower link member is a U-shaped rod, said lower link member being adapted and correctly dimensioned to engage said user's leg like a yoke.

Preferably, said first pivot means are then positioned edgewisely and laterally relative to said ski body top surface orifice.

Advantageously, said sections of said lower link member and upper link member are ellipsoidal.

Profitably, said loop band defines circumference adjustment means, for adjusting the length of said loop band.

BRIEF DESCRIPTION OF THE DRAWINGS

FIG. 5 is a front elevational view of a third embodiment of the invention;

DETAILED DESCRIPTION OF THE INVENTION

The present invention consists of a leg support adapted for water skis for use in towless water skiing; that is to say, the user of such water skis propels himself instead of being towed by a motor boat. The skis are elongated hulls composed of a buoyant material, e.g. expanded polystyrene foam, to float upon the water while supporting a user in upright position. It is known in the art, as previously stated in this document that orifices be formed in the hulls, and that there be cavities corresponding to these orifices, these cavities being adapted and correctly dimensioned to receive the feet of the user in them to rest on footrests. It is known also to provide bindings fixed inside the cavity, on the bottom surface of the hulls, and boots which are adapted to be attached by the bindings to the hulls, so as to provide a steady footing for the user of the skis. These bindings can be, for example, toe bindings that fasten the front part of the boots to the hulls, similarly to the bindings used in cross-country skiing. These toe bindings have the advantage of allowing the user to lift his heels from the bottom surface of the skis and to perform a back and forth motion to advance, as in cross-country skiing.

Figure 1:
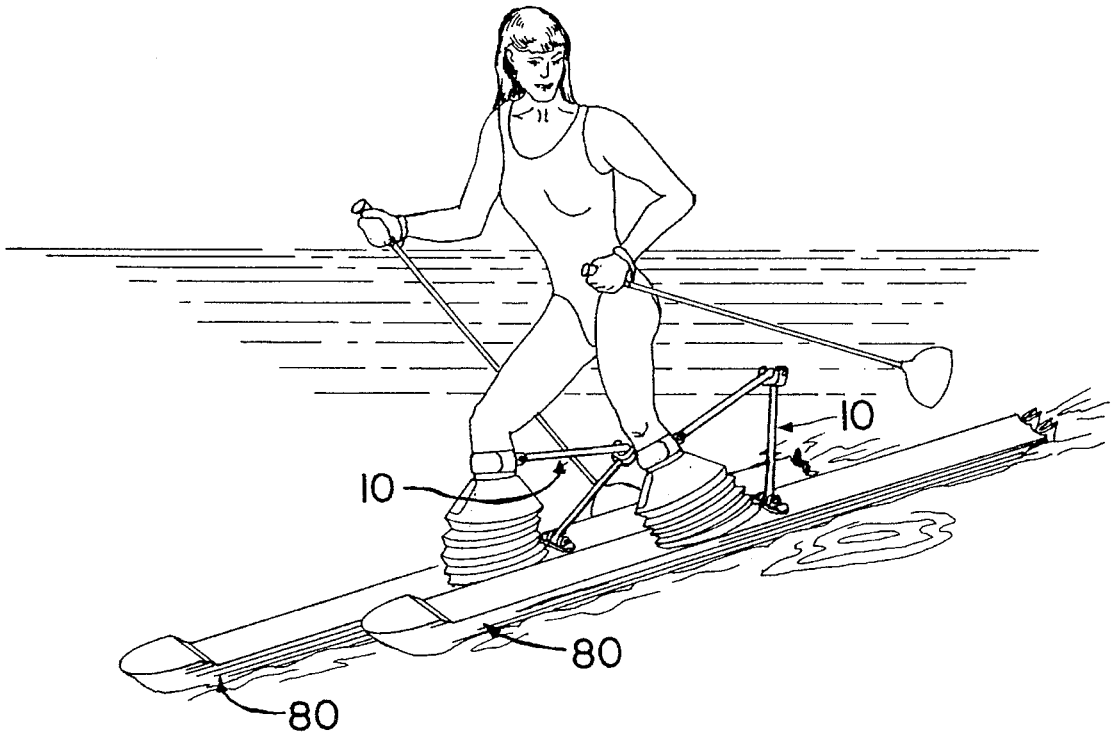
FIG. 1 is a perspective view showing a person using water skis equipped with a first embodiment of the present invention.

Now referring to the annexed drawings, FIG. 1 shows a person using water skis 80 equipped with a pair of a first embodiment of leg supports 10, 10. The leg supports 10, 10 are identical, and only one leg support 10 will be described.

Figure 2:
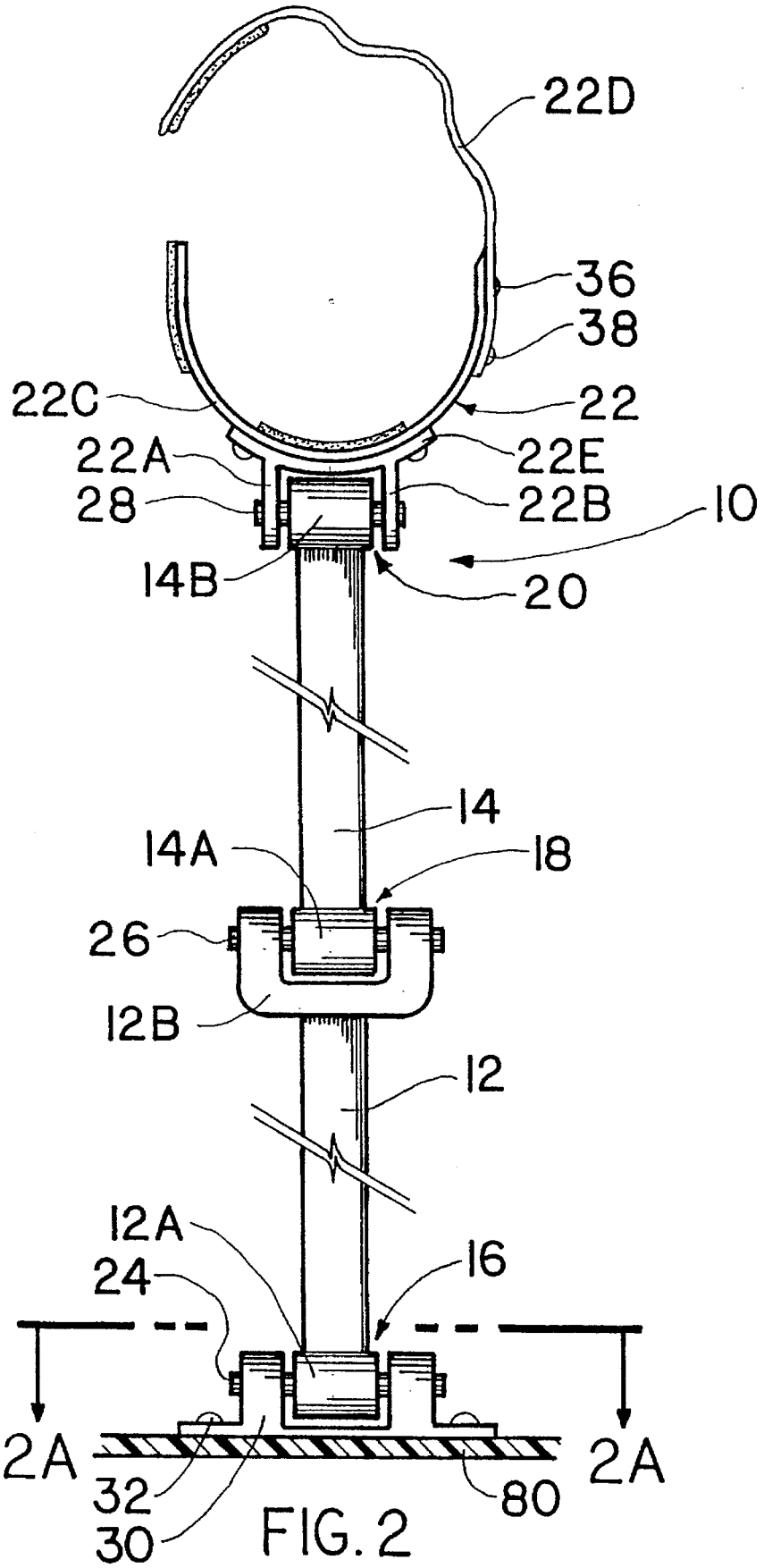
FIG. 2 is a front elevational view of the embodiment of FIG. 1, taken along line 2—2 of FIG. 2A.

Leg support 10, as can be seen on FIG. 2, comprises a lower elongated link member, or lower rod, 12, which is adapted to be attached to water ski 80 through the instrumentality ski hinge 16. Lower rod 12 is linked to an upper elongated link member, or upper rod, 14, by an intermediate hinge 18. Finally, a leg attachment 22 is attached to upper rod 14 by an upper hinge 20.

Figure 2A:
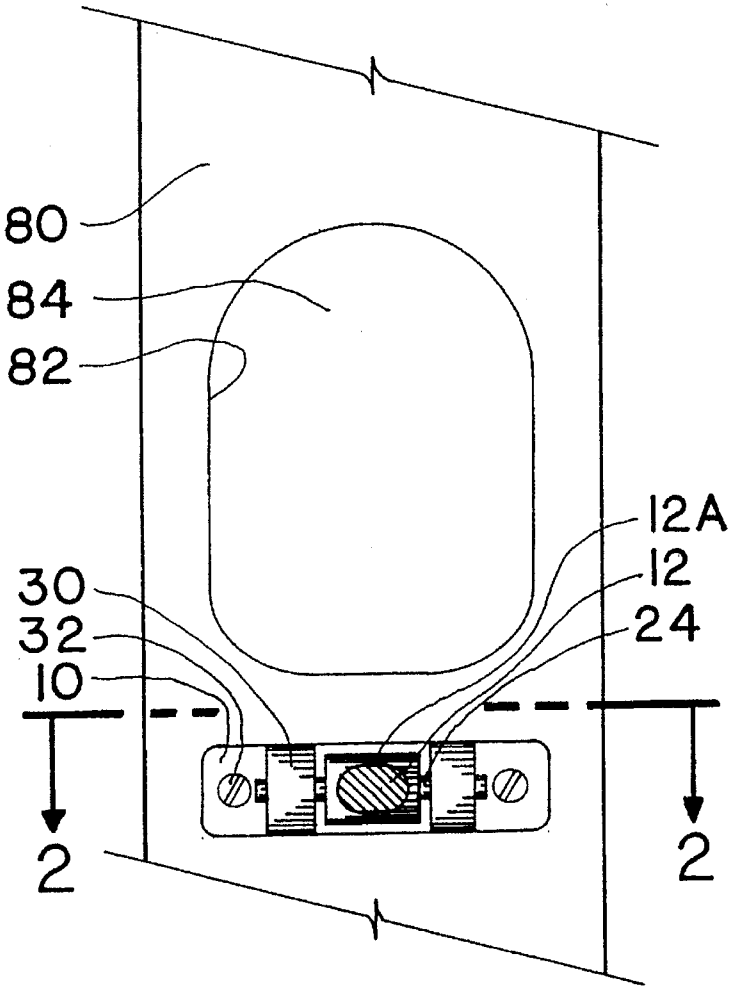
FIG. 2A is a partial top plan view of a water ski equipped with the embodiment of FIGS. 1 and 2.

FIGS. 2 and 2A show that lower rod 12 defines, at its lower extremity, an integral cylindrical socket member 12*a*, to be pivotally engaged by a shaft 24. Shaft 24 is fixed at its two extremities on a U-shaped anchoring member 30, the latter being bolted to water ski 80 by bolts 32, 32. U-shaped anchoring member 30 forms, at its two extremities, two coaxial bores which are correctly dimensioned to be fixedly engaged by shaft 24. This press-fitted socket member 12*a* is positioned between the two extremeties of U-shaped anchoring member 30, so as to prevent socket member 12*a* (and consequently rod 12) from any movement in the direction of the axis of shaft 24. Anchoring member 30, shaft 24 and socket 12*a* form ski hinge 16.

FIG. 2A further shows the roughly ellipsoidal section of rod 12, rod 14 being of similar section.

As can be seen on FIG. 2, rod 12 defines, at its upper extremity, an integral U-shaped shaft-receiving member 12*b*, forming two coaxial bores which are correctly dimensioned to be fixedly engaged by shaft 26. The latter pivotally engages a cylindrical socket 14*a* between the two extremities of shaft-receiving member 12*b*, thus preventing any movement of socket 14*a* in the direction of the axis of shaft 26. Socket 14*a* is integrally formed at the lower extremity of upper rod 14. Shaft-receiving member 12*b*, shaft 26 and socket 14*a* form intermediate hinge 18.

Rod 14 defines, at its upper extremity, a second integral cylindrical socket 14*b*, to be pivotally engaged by a shaft 28, the latter fixedly engaging two short, thin, parallel, shaft-receiving plates 22*a*, 22*b*, having two coaxial through bores, the bores being correctly dimensioned to be fixedly engaged by shaft 28. Second socket 14*b* is positioned between thin shaft-receiving plates 22*a*, 22*b*, so as to prevent any movement in the direction of the axis of shaft 28. Socket 14*b*, shaft 28 and plates 22*a*, 22*b* form upper hinge 20.

Shafts 24, 26 and 28 are parallel to one another. Since they do not allow any movement in the direction of their axes, the entire leg support 10 allows movement only in a plane perpendicular to the axes of shafts 24, 26 and 28.

Thin plates 22*a*, 22*b* are in fact two parallel extremities of a single leg attachment fastening member 22*e*, which fastens leg attachment 22 to hinge 20. Leg attachment fastening member 22*e* defines, on the side opposite to thin plates 22*a*, 22*b*, an arcuate surface adapted to conform with the calf of the user. A cushioned calf strap 22*c* is fixed on the arcuate surface of leg attachment fastening member 22*e*, calf strap 22*c* being wide enough to avoid contact between the user's calf and leg attachment fastening member 22*e* for greater comfort of the user. Calf strap 22*c* is fixed by its center, thus defining two extremities.

A tibia strap 22*d* is releasably anchored at its first extremity to the first extremity of calf strap 22*c* by small bolts 36, 38, which allow a length adjustment of tibia strap 22*d*. The leg attachment 22 is adapted to receive the user's leg, the calf resting upon the calf strap 22*c*, the tibia strap 22*d* afterwards being wrapped around the front part of the leg, on the tibia, until its second extremity can be realeasably attached to the second extremity of calf strap 22*c* by attachment means, such as the means known as VELCRO (Registered trademark). There attachment means are adapted to allow a size adjustment of the circumference formed by calf strap 22*c* and tibia strap 22*d*, once tibia strap 22*d* is attached to calf strap 22*c*. Calf strap 22*c*, tibia strap 22*d* and leg attachment fastening member 22*e* form the leg attachment, or loop band, 22.

Figures 3A, 3B, 3C:
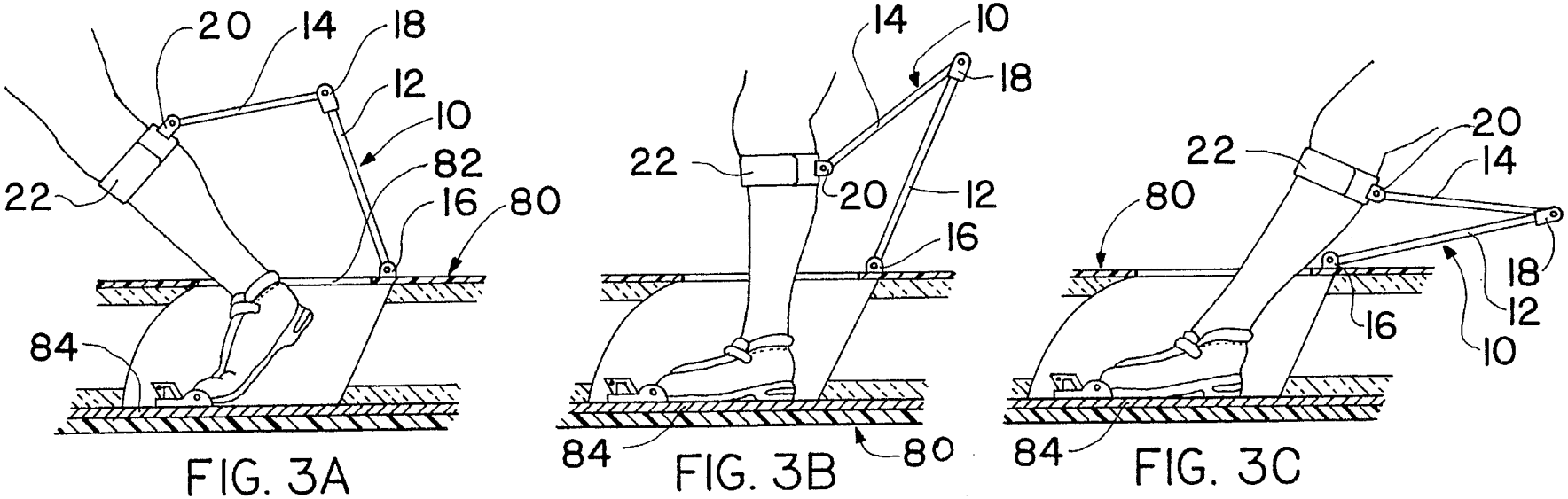
FIGS. 3A, 3B, and 3C are partial longitudinal sections of a water ski equipped with the embodiment of FIG. 1 and 2A, the latter together with the leg of a user shown in elevation, the three sections sequentially suggesting the back and forth movement of the leg and foot of the user.

Since, as it as been explained previously, hinges 16, 18, 20 allow only a movement in a plane perpendicular to shafts 24, 26, 28, once the user's leg is secured by leg attachment 22 to leg support 10, the user cannot pivot his leg laterally, but only in a plane perpendicular to shafts 24, 26, 28, as sequentially suggested in FIGS. 3A to 3C. The back and forth movement (FIGS. 3A to 3C) which is executed by those skilled in the art of towless water skiing, movement which is similar to the movement executed by cross-country skiers, will not be hindered by leg support 10, though the latter will not permit any movement in an other plane than the one parallel to the longitudinal axis of the water ski 80 and perpendicular to the upper surface of footrest 84.

Therefore, the user of water skis equipped with leg supports 10, 10 does not have to control the pivoting of his ankles, since they would be "blocked" by leg supports 10, 10. It is thus be much easier for the user to control and prevent the drifting of the hulls or water skis 80.

FIGS. 3A to 3C and FIG. 2A also show that leg support 10 is adapted to be installed on the upper wall of hull or ski 80, behind the orifice 82 fromed in said upper wall. With leg support 10 in such a position, the user's leg will not come into contact with it.

Furthermore, we can observe that rods 12, 14 occupy different positions, relative to the hull 80, through the instrumentality of hinges 16, 18, 20. Hinges 16, 18, 20 permit rotations of elongated rods 12, 14 at each of their respective extremities, which allows rods 12, 14 a relative freedom of movement in the plane parallel to the longitudinal axis of the ski 80.

FIGS. 3A to 3C further show leg attachment 22 wrapped around a user's leg.

Figure 4A:
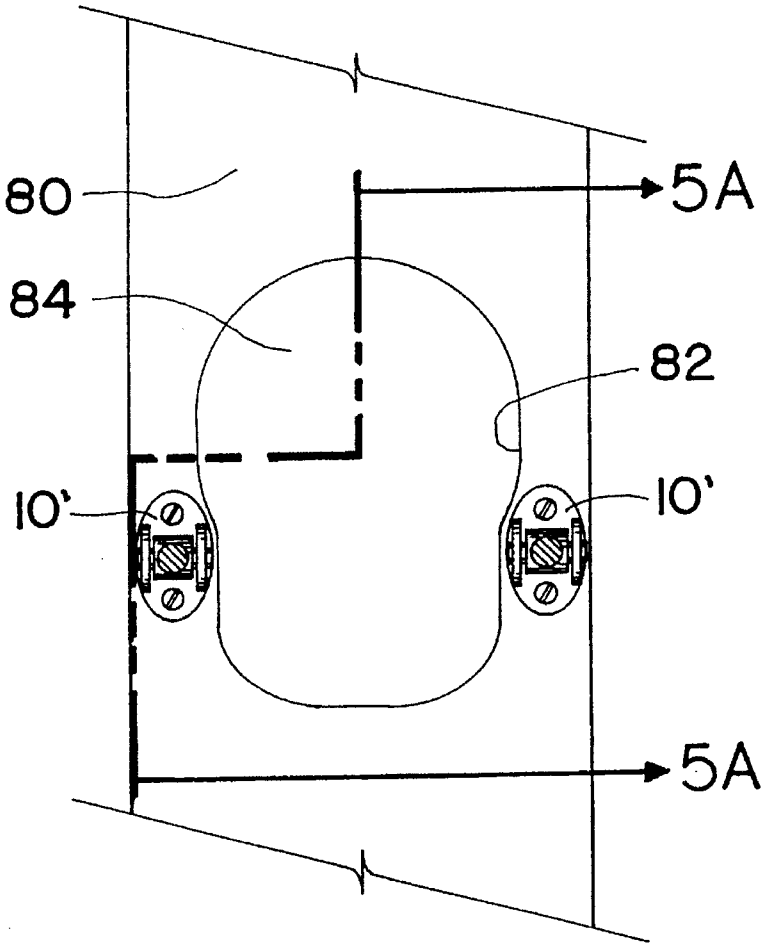
FIG. 4A is a partial top plan view of a water ski equipped with the embodiment of FIG. 4.
Figure 4:
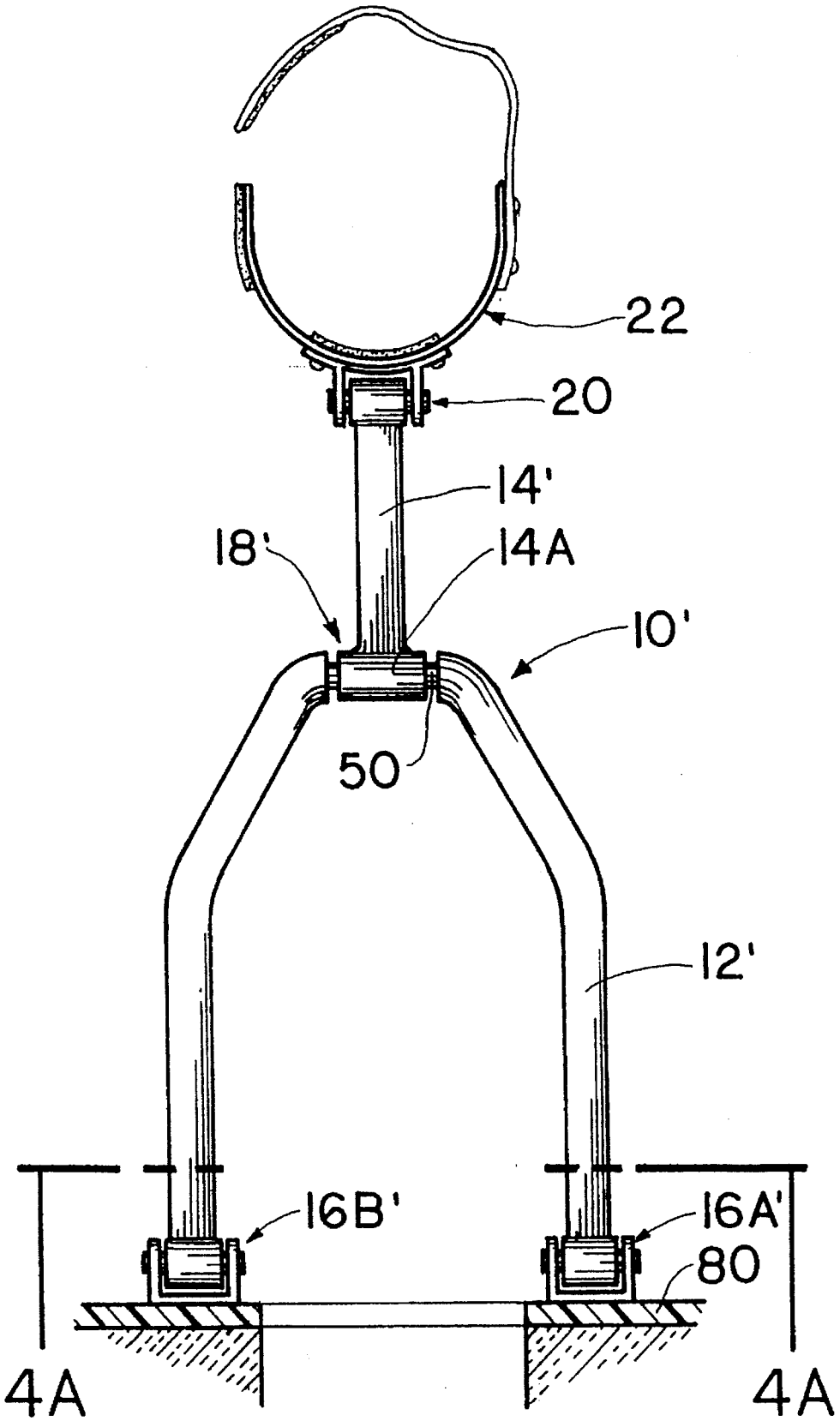
FIG. 4 is a front elevational view of a second preferred embodiment of the invention.

A preferred embodiment of the invention is shown on FIG. 4. In this embodiment, leg support 10' is very similar to leg support 10 of the above-described embodiment, but elongated rod 12 is replaced by a V-shaped rod 12', which is fixed on ski 80 at its extremities by two ski hinges 16*a'* and 16*b'*, instead of only one ski hinge 16 Intermediate hinge 18 is replaced by intermediate hinge 18': V-shaped rod 12' forms a reduced diameter section 50 (of circular section) which corresponds to shaft 26 of the first embodiment, which engages unchanged socket 14*a* of rod 14' between the wider diameter sections of V-shaped rod 12' to prevent socket 14*a* from any movement parallel to the axis of reduced diameter section 50.

Other than the above-mentioned changes and the lengths of the rods 12', 14' (explained hereafter), leg support 10' is the same as leg support 10.

Figure 5C:
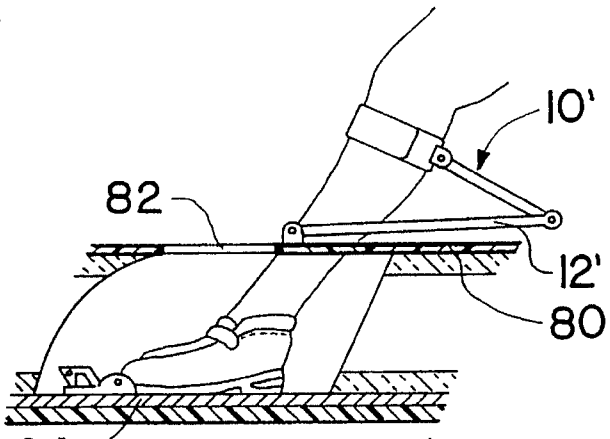
FIGS. 5A, 5B and 5C are partial longitudinal sections taken along line 5A—5A of FIG. 4A, and showing in elevationg a water ski equipped with the embodiment of FIG. 4 fitted to the leg of a user.
Figure 5B:
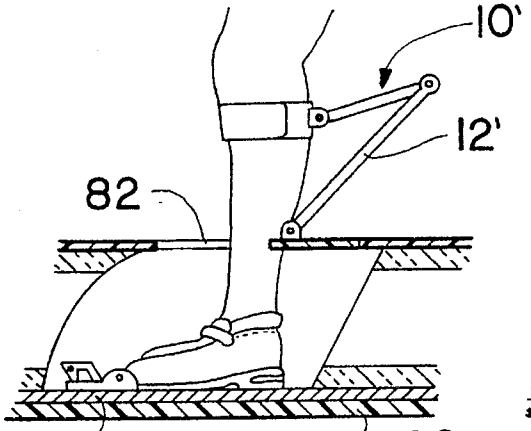
Figure 5A:
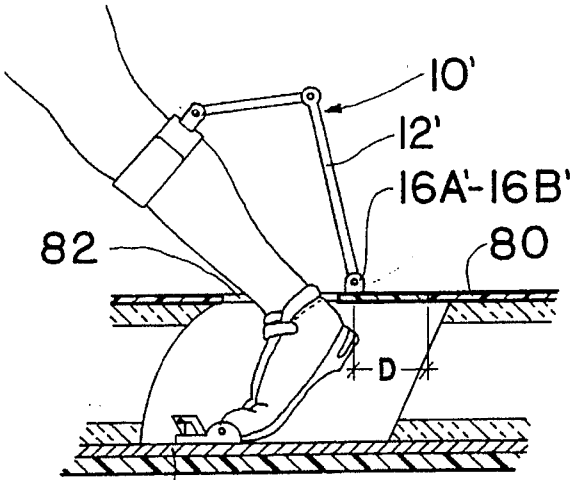

FIGS. 5A to 5C and FIG. 4A show that leg support 10' is positioned much closer to the user's leg than the first embodiment, the two extremities of V-shaped rod 12' being adapted and correctly spaced to be attached (by hinges 16*a'*, 16*b'*) on one side and the other of the user's leg. The V-shaped rod 12' therefore forms a yoke around the user's leg when the leg is inclined backwards (FIG. 5C). The hinges 16*a'*, 16*b'* are fixed edgewisely on each side of orifice 82 at a distance D from the rear of orifice 82 which is inferior to half of the total length of orifice 82 (FIG. 4A).

With this, new embodiment, the rods 12', 14' may be shorter than rods 12, 14 of the first embodiment, because of the position of hinges 16*a'*, 16*b'* relative to the user's leg (hinges 16*a'*, 16*b'* are closer to the user's leg) This is desirable, because leg support 10' will thus be less bulky, occupying less space behind the user's leg, over hull 80. Furthermore, leg support 10' will possess a better resistance to lateral bending, relative to the longitudinal axis of ski 80, because of the two arms of rod 12' instead of the single arm of rod 12. Advantageously, the leg support of the invention will be of the form 10' rather than the form 10.

Figure 6:
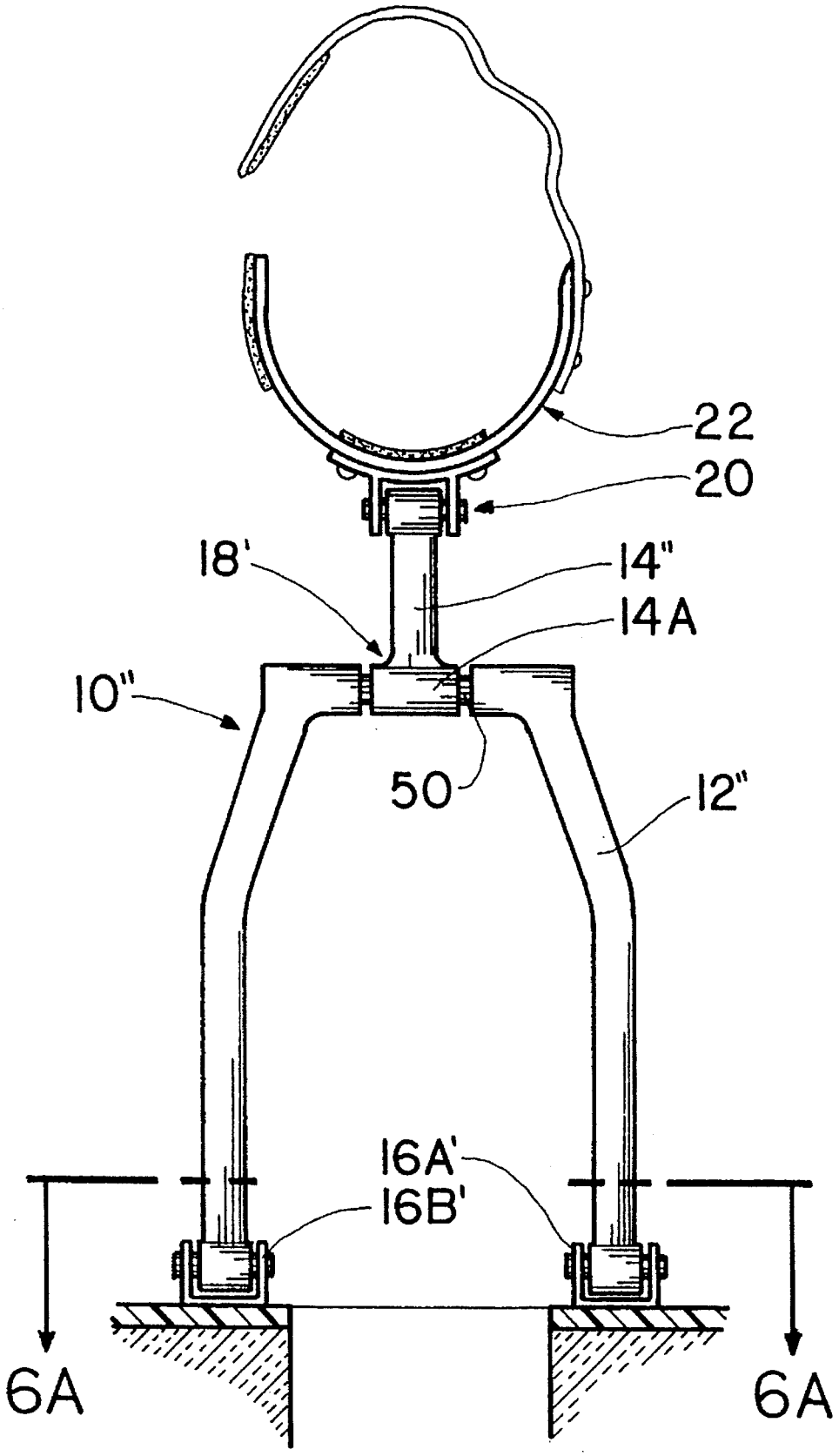
FIG. 6A is a partial top plan view, of a water ski equipped with the embodiment of FIG. 6.

A third embodiment of the invention is shown on FIG. 6. This embodiment is very similar to the second embodiment of the invention.

Leg support 10" comprises a U-shaped rod 12" instead of a V-shaped rod 12'. The distance between the arms of U-shaped rod 12" near intermediate hinge 18' is greater than the one between the arms of V-shaped rod 12'. This allows the leg to pass further between the arms of rod 12", up to intermediate hinge 18'.

Other than the shape of rod 12" and the lengths of rods 12" and 14" (detailed hereafter), the leg support 10" is the same as leg support 10'.

Figure 6A:
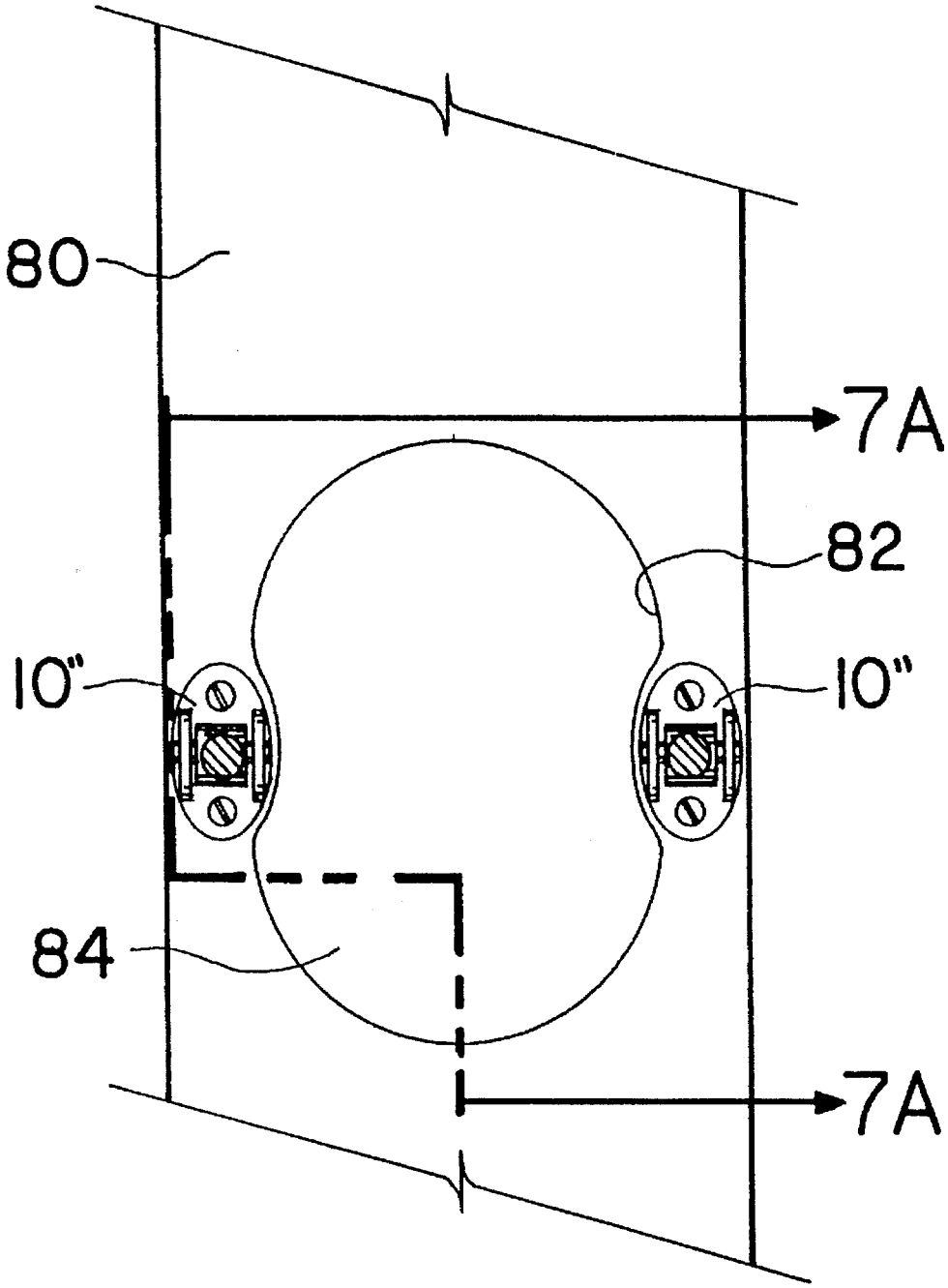
Figures 7A, 7B, 7C:
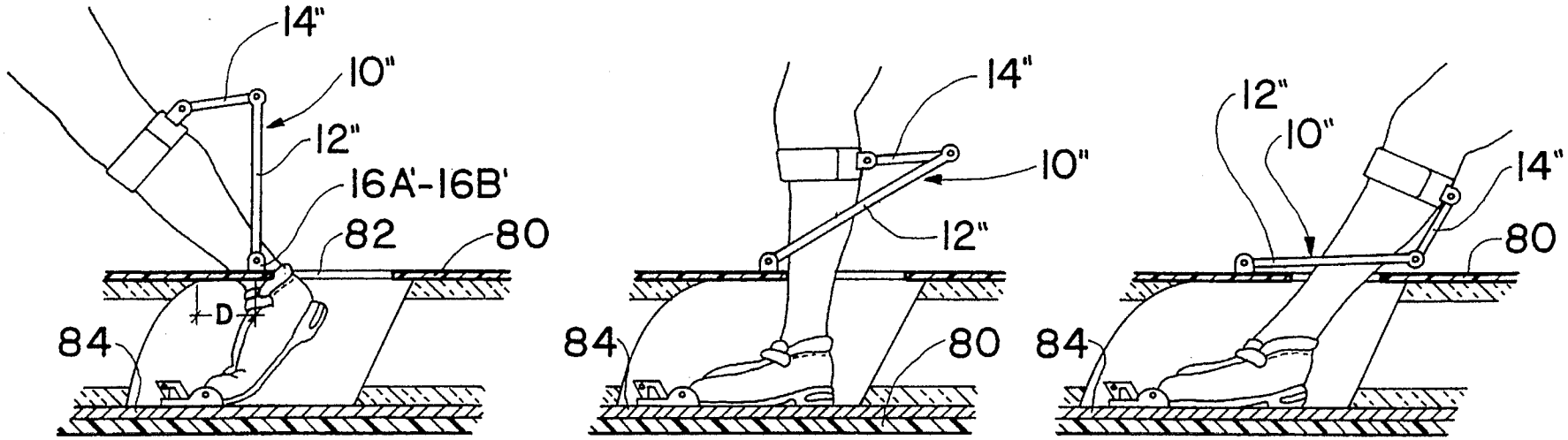
FIGS. 7A, 7B and 7C are views similar to FIGS. 5A to 5C, but taken along line 7A—7A of FIG. 6A, and applied to the embodiment of FIG. 6.

FIGS. 7A to 7C and FIG. 6A show that leg support 10" is positioned further up front on hull 80, compared to leg supports 10 or 10'; it is still close to the user's leg, the two extremities of U-shaped rod 12" being adapted and correctly spaced to be attached (by hinges 16*a'*, 16*b'*) to hull 80 on one side and the other of the user's leg. The U-shaped rod 12" therefore forms, as in the previous embodiment, a yoke around the user's leg. The hinges 16*a'*, 16*b'* are fixed edgewisely on each side of orifice 82 at a distance D from the front of orifice 82 which is inferior to half of the total length of orifice 82 (FIG. 7A and 6A).

With this third embodiment, the rods 12", 14" may be shorter than rods 12, 14 of the first embodiment, because of the position of hinges 16*a'*, 16*b'* relative to the user's leg (hinges 16*a'*, 16*b'* are closer to the user's leg); there length is similar to the length of rods 12' 14' of the second embodiment. Once again, the reduced length is desirable, because leg support 10" will thus be less bulky, occupying less space behind the user's leg, over hull 80. Though its length is similar to leg support 10' leg support 10" is even less bulky, because the extremities of U-shaped rod 12" are attached further up front (with hinges 16*a'* and 16*b'*), which occupies less space behind the user's leg. Indeed, the rods 12" and 14" tend to adopt a position which is much closer to the user's leg (e.g. FIG. 7A compared to FIGS. 3A or 5A) or the hull 80 upper surface (e.g. FIG. 7C compared to FIGS. 3C or 5C), therefore being less bulky. Also, leg support 10" possesses a better resistance to lateral bending, relative to the longitudinal axis of ski 80, because of the two arms of rod 12" instead of the single arm of rod 12. Advantageously, the leg support of the invention will thus be of the form 10" rather than the form 10' or 10.

It is understood that when we refer to the length of V-shaped rod 12' or U-shaped rod 12", it is the distance between ski hinges 16*a'*, 16*b'* and intermediate hinge 18' rather than the total length of the two arms composing V-shaped rod 12' or U-shaped rod 12".

It is important to note that the rods 12, 12', 12", 14, 14', 14" are preferably made of a rigid material, such as stainless steel or fibreglass-reinforced plastic, for it must not bend under an imposed stress from the user, the leg support then loosing its purpose.

I claim:

1. A leg support for use on towless water skis, each of said water skis comprising an elongated buoyant thick ski body defining top and bottom surfaces, an orifice on said ski body top surface leading to a foot cavity for receiving the foot of a user of said ski body on a footrest, said leg support comprising:

a) a loop band, to be releasably tightened around the calf and tibia of said ski body user;

b) elongated link means having an upper and a lower end;

c) first pivot means, adapted to pivotally connect the lower end of said link means to said ski body, said first pivot means defining a pivotal axis perpendicular to a plane parallel to the longitudinal axis of said ski body and perpendicular to said ski body footrest when connected to said ski body;

d) second pivot means, pivotally connecting said upper end of said link means to said loop band, said second pivot means defining a pivotal axis parallel to said first pivot means pivotal axis, wherein when said first pivot means is connected to said ski body, said loop band is movable over said ski body top surface exclusively about a translational plane perpendicular to the pivotal axes of said first and second pivot means; said link means including a lower and an upper link member each having a lower and an upper end, the lower end of said lower link member constituting the lower end of said link means and the upper end of said upper link member constituting the upper end of said link means, said leg support further including a third pivot means, pivotally connecting said lower link member to said upper link member, said third pivot means defining a pivotal axis parallel to the pivotal axes of said first and second pivot means, wherein both said upper and lower link members are pivotally movable exclusively in a common plane; wherein said lower link member is a V-shaped rod, said lower link member being adapted and correctly dimensioned to engage said user's leg like a yoke.

2. A leg support as defined in claim 1, wherein said first pivot means are positioned edgewisely and laterally relative to said orifice.

3. A leg support for use on towless water skis, each of said water skis comprising an elongated buoyant thick ski body defining top and bottom surfaces, an orifice on said ski body top surface leading to a foot cavity for receiving the foot of a user of said ski body on a footrest, said leg support comprising:

a) a loop band, to be releasably tightened around the calf and tibia of said ski body user;

b) elongated link means having an upper and a lower end;

c) first pivot means, adapted to pivotally connect the lower end of said link means to said ski body, said first pivot means defining a pivotal axis perpendicular to a plane parallel to the longitudinal axis of said ski body and perpendicular to said ski body footrest when connected to said ski body;

d) second pivot means, pivotally connecting said upper end of said link means to said loop band, said second pivot means defining a pivotal axis parallel to said first pivot means pivotal axis, wherein when said first pivot means is connected to said ski body, said loop band is movable over said ski body top surface exclusively about a translational plane perpendicular to the pivotal axes of said first and second pivot means; said link means including a lower and an upper link member each having a lower and an upper end, the lower end of said lower link member constituting the lower end of said link means and the upper end of said upper link member constituting the upper end of said link means, said leg support further including a third pivot means, pivotally connecting said lower link member to said upper link member, said third pivot means defining a pivotal axis parallel to the pivotal axes of said first and second pivot means, wherein both ssaid upper and lower link members are pivotally movable exclusively in a common plane; wherein said lower link member is a U-shaped rod, said lower link member being adapted and correctly dimensioned to engage said user's leg like a yoke.

4. A leg support as defined in claim 3, wherein said first pivot means are positioned on said ski body edgewisely and laterally relative to said orifice.

* * * * *